US012345045B2

(12) United States Patent
McManus

(10) Patent No.: US 12,345,045 B2
(45) Date of Patent: Jul. 1, 2025

(54) PANELIZED SERRATED BEAM ASSEMBLY

(71) Applicant: SIMPSON STRONG-TIE COMPANY INC., Pleasanton, CA (US)

(72) Inventor: Patrick McManus, Fort Collins, CO (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 17/572,839

(22) Filed: Jan. 11, 2022

(65) Prior Publication Data

US 2022/0220734 A1 Jul. 14, 2022

Related U.S. Application Data

(60) Provisional application No. 63/199,592, filed on Jan. 11, 2021.

(51) Int. Cl.
*E04B 5/40* (2006.01)
*E04B 1/24* (2006.01)
(Continued)

(52) U.S. Cl.
CPC ..... *E04B 5/40* (2013.01); *E04B 1/24* (2013.01); *E04B 1/388* (2023.08); *E04C 3/06* (2013.01); *E04B 2001/2484* (2013.01)

(58) Field of Classification Search
CPC ..... E04B 1/24; E04B 1/40; E04B 2001/2484; E04B 5/40; E04C 3/06
(Continued)

(56) References Cited

U.S. PATENT DOCUMENTS 1,885,883 A * 11/1932 Young ..... E04B 5/29 52/334
2,246,578 A * 6/1941 De Salardi ..... E04C 5/06 52/630
(Continued)

FOREIGN PATENT DOCUMENTS

EP 0084961 8/1983
GB 2164966 4/1986
(Continued)

OTHER PUBLICATIONS

International Search Report and Written Opinion dated Apr. 21, 2022 in International Patent Application No. PCT/US2022/011977.
(Continued)

*Primary Examiner* — James J Buckle, Jr.
(74) *Attorney, Agent, or Firm* — Pearl Cohen Zedek Latzer Baratz LLP

(57) ABSTRACT

A structural beam and deck assembly containing portions of beam members interconnected by a deck assembly. Beam members have horizontal top and bottom flange elements interconnected by one or more vertical web member. The top flange of the beam members is serrated such that a series of serrations protrude horizontally in at least one direction from a top of the one or more vertical web member or are cut-out from the flange of a rolled shape. Adjacent beam and deck assemblies are installed such that attachment of one portion of a beam member to another results in the completed cross section of the beam member. In one embodiment, the serrated top flange and at least a portion of the web member are intended to be encased by a horizontal concrete slab. The slab material is capable of encasing all exposed surfaces of and curing around each serration to transfer horizontal shear forces between the serrated top flange and the slab material such that the beam members and slab behave compositely.

7 Claims, 6 Drawing Sheets

(51) Int. Cl.
*E04B 1/38* (2006.01)
*E04C 3/06* (2006.01)

(58) Field of Classification Search
USPC ..... 52/702
See application file for complete search history.

(56) References Cited

U.S. PATENT DOCUMENTS 2,928,512 A * 3/1960 Slater ..... F16B 7/0446 403/22
3,626,653 A * 12/1971 Amirikian ..... E04C 3/30 52/843
4,338,381 A * 7/1982 Rogers ..... E04C 3/04 52/287.1
5,509,243 A * 4/1996 Bettigole ..... E04B 5/36 52/414
5,664,378 A * 9/1997 Bettigole ..... E01D 19/125 404/70
7,556,454 B2 * 7/2009 Cable ..... E02D 5/28 405/254
10,151,106 B2 * 12/2018 Niemann ..... E06B 1/36
11,028,573 B1 * 6/2021 McManus ..... E04B 5/29
2006/0150571 A1 * 7/2006 Zahner ..... E04C 3/40 52/838
2021/0222434 A1 * 7/2021 McManus ..... E04C 5/065
2023/0154119 A1 * 5/2023 Walens ..... A63F 13/218 345/633

FOREIGN PATENT DOCUMENTS

WO 9745604 12/1997
WO 2006064989 6/2006

OTHER PUBLICATIONS

Notification of Reasons for Rejection dated Apr. 23, 2024 in Japanese Patent Application No. 2023-541821.
Examination Report dated Jul. 15, 2024 in Australian Patent Application No. 2022205428.
Response to Office Action dated Oct. 23, 2024 in Japanese Patent Application No. 2023-541821.
Office Action dated Oct. 30, 2024 in Korean Patent Application No. 10-2023-7023374.
Notice of Allowance dated Feb. 5, 2025 in Japanese Patent Application No. 2023-541821.

* cited by examiner

TOP VIEW

TOP VIEW (ALT)

PANELIZED SERRATED BEAM ASSEMBLY

CLAIM OF PRIORITY

The present application claims priority to U.S. Provisional Patent Application No. 63/199,592 filed on Jan. 11, 2021 entitled "PANELIZED SERRATED BEAM ASSEMBLY", which application is incorporated by reference herein in its entirety.

BACKGROUND OF THE INVENTION

Field of the Invention

The present invention relates to a structural beam and deck assembly primarily intended to transfer vertical loads through shear and flexural actions along the length of the member to one or more structural supports.

Description of Related Art

Composite beams and joists are widely used in conventional steel construction. Typically, the beam or joist is located entirely below the composite slab-on-deck assembly. The transfer of horizontal shear forces between the concrete slab and the steel beam or joist is most commonly accomplished through the use of shear connectors, often in the form of headed anchor studs, which are welded to the top of the beam or joist prior to slab placement. Beams and decking to support the concrete slab are usually manufactured and installed as separate, individual elements.

SUMMARY OF THE INVENTION

The present invention utilizes beam members, each with a serrated top flange encased in the concrete slab wherein the headed serrations provide for the transfer of horizontal shear forces between the steel member and the concrete slab. Portions of the overall cross section of the beam members are attached to each end of decking prior to installation to create a beam and deck assembly. Installation of the beam and deck assemblies involves connecting adjacent beam and deck assemblies by attaching the portions of each beam member to create the overall cross sections of the beam members. The present invention is directed toward a structural beam and deck assembly spanning substantially horizontally between one or more supports wherein the top flange of the cross section of the beam members is comprised of serrated geometry. In one embodiment, the serrated geometry comprises portions of one or both sides of the top flange of an I-beam being cut out in an alternating pattern. Many cut-out patterns in the flange, as well as configurations of steel beam member shapes and flange orientations are possible. The top flange of the cross section is intended to be encased by a typically concrete slab such that the serrations in the top flange of the beam member are encapsulated or encased by the concrete slab and, thereby facilitate horizontal shear transfer between the cross section and the surrounding slab medium thereby creating composite action between the member and surrounding slab. The primary function of this composite beam member is to transfer vertical loads applied along the length of the beam member to one or more supports along the length of the member through shear and flexural forces in the composite assembly.

The portions of the beam member attached to each deck assembly may be comprised of unitary construction or built-up of structural plates, angles, 'T' shaped, 'I' shaped, 'C' shaped, rectangular or other similar geometric cross sections, though the use of other cross sections are also within the scope of the present invention. The serrations each side of the top flange of the member may be aligned in various configurations, such as alternating portions on the respective sides of the web, or mirror images on either side of the web. Multiple shapes of cut-outs and remaining portions of the flange are provided but may take the form of any shape which facilitates the composite action contemplated herein.

In one embodiment, the member may be self-contained as a beam acting compositely with the surrounding slab. While the shape of the serrations in this embodiment is substantially rectangular, the use of square, circular, elliptical, bulbed, 'L' shaped, 'T' shaped or other geometry is within the scope of the present invention.

While the member is envisioned to be comprised of steel material, the decking comprised of corrugated steel material and the slab comprised of concrete material, the use of other materials is also within the scope of the present invention. The member in its entirety or individual components of the member may be formed from metal, primarily structural steel, through known fabrication processes such as cutting from plate, casting, built up of welded or bolted shapes, machining, forming from cold bending of plates, extruding, hot rolling, or from other fabrication or manufacturing processes. However, other known materials, such as carbon fiber or other metals, and other manufacturing processes are also within the scope of the present invention. Other decking materials such as wood, plastic, carbon fiber or other metals are also within the scope of the present invention. Other slab materials, such as asphalt, epoxy or other cementitious materials are also within the scope of the present invention.

DESCRIPTION OF THE SEVERAL VIEWS OF THE DRAWINGS

The accompanying drawings form a part of the specification and are to be read in conjunction therewith, in which like reference numerals are employed to indicate like or similar parts in various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit of the scope of the present invention. The present invention is defined by the appended claims and, therefore, the description is not to be taken in a limiting sense and shall not limit the scope of the equivalents to which such claims are entitled.

The present provisional patent application incorporates the teachings of U.S. application Ser. No. 15/929,292 in its entirety by reference.

Figure 1:
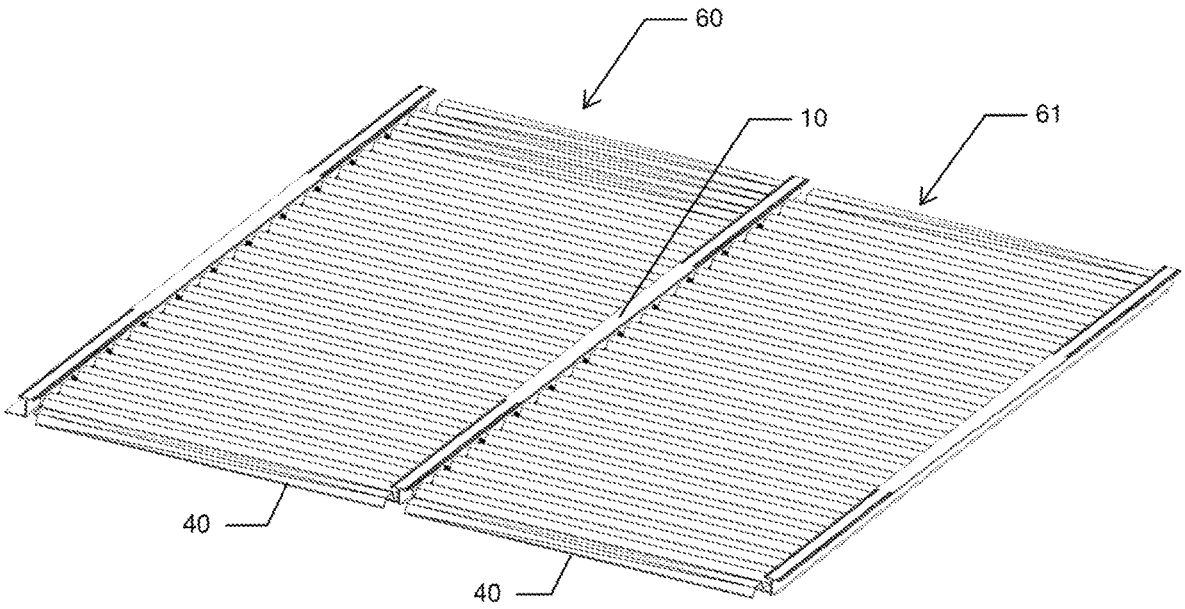
FIG. 1 is an overall isometric view of one embodiment of a load carrying structural beam and deck assembly in accordance with the teachings of the present disclosure.

FIG. 1 shows an isometric view of adjacent beam and deck assemblies 60 and 61 each of which include a deck assembly 40. Adjacent beam and deck assemblies 60 and 61 when attached to each other during installation form the full cross section of beam member 10.

Figure 2:
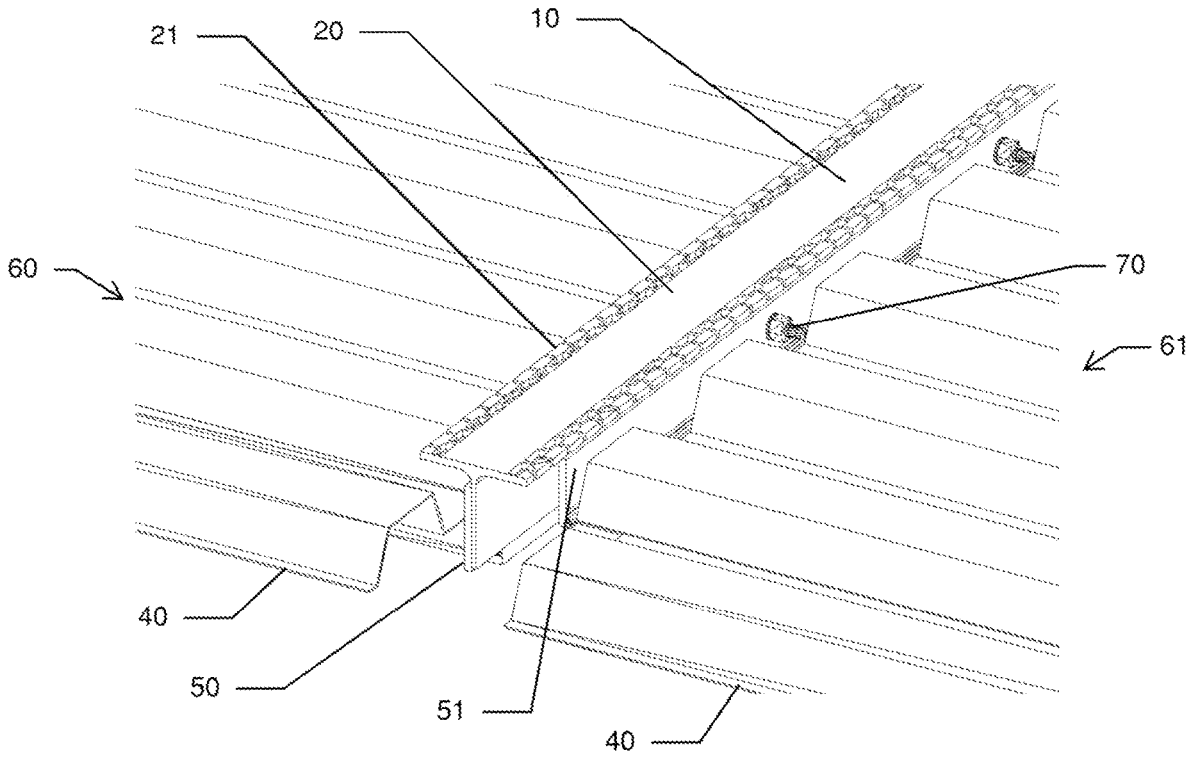
FIG. 2 is blown-up partial isometric view of the embodiment shown in FIG. 1 in accordance with the teachings of the present disclosure.

FIG. 2 shows a blown-up partial isometric view of the embodiment of FIG. 1. Beam and deck assembly 60 is comprised of a portion 50 of the overall cross section of beam member 10, portion 50 being connected to a deck assembly 40 prior to installation. Beam and deck assembly 61 is comprised of a portion 51 of the overall cross section of beam member 10, portion 51 being connected to a deck assembly 40 prior to installation. Upon installation beam and deck assembly 60 is attached to adjacent beam and deck assembly 61 by fastening portion 50 to portion 51 using fasteners 70. Fasteners 70 could be bolts, rivets, welds, or any structural connection now known or hereafter developed. The connection of portion 50 to portion 51 results in the completion of the full cross section of beam member 10, which is comprised of serrated top flange 20. Aligned serrations 21 protrude horizontally from each side of serrated top flange 20. A concrete slab (not shown) is to be placed over deck assemblies 40 to a thickness fully encasing serrated top flange 20. Serrations 21 engage the concrete slab such that the serrated top flange 20 and the concrete slab undergo strains of similar magnitude and direction under applied loading along the length of top flange 20 thereby creating composite action. Decking 40 spans between the bottom flange of the beam members to support the concrete slab during placement and participates in transferring superimposed loads imparted to the concrete slab to beam member 10. The connection of deck assembly 40 to beam member 10 restrains beam member 10 from torsional movement thereby mitigating lateral torsional buckling of beam member 10 during placement of the concrete slab.

Generally throughout, the use of concrete for the concrete slab may be another structural medium which can be poured or installed in more of a liquid state, then cured or solidified into a more rigid or solid state. Concrete is a good example, but it could be flowable grout, epoxy mixtures, or other similar structural medium.

Figure 3A:
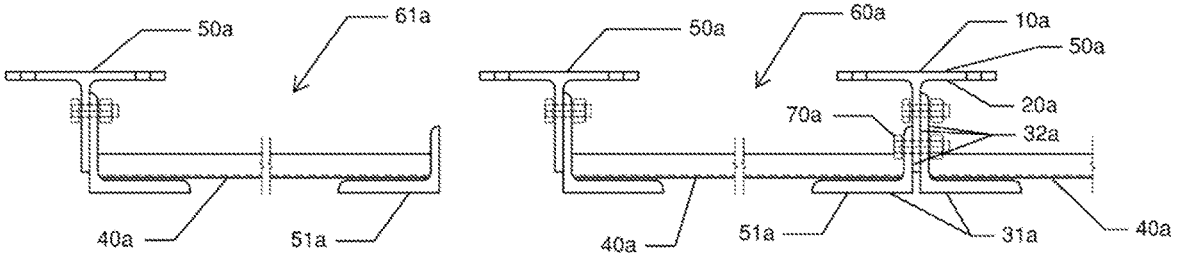
FIG. 3A is a section view of one embodiment of a load carrying structural beam and deck assembly in accordance with the teachings of the present disclosure.
Figure 3B:
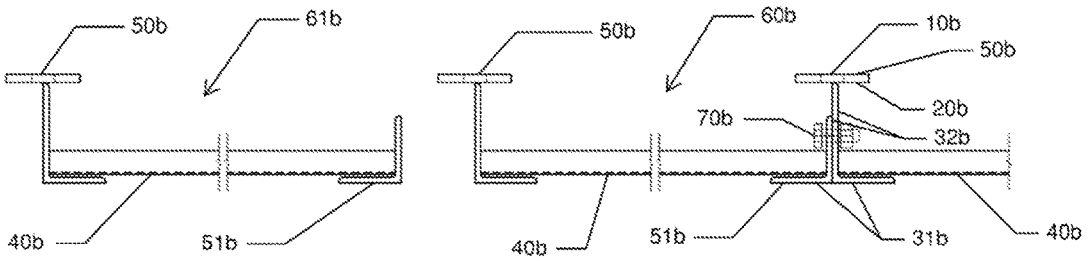
FIG. 3B is a section view of one embodiment of a load carrying structural beam and deck assembly in accordance with the teachings of the present disclosure.
Figure 3C:
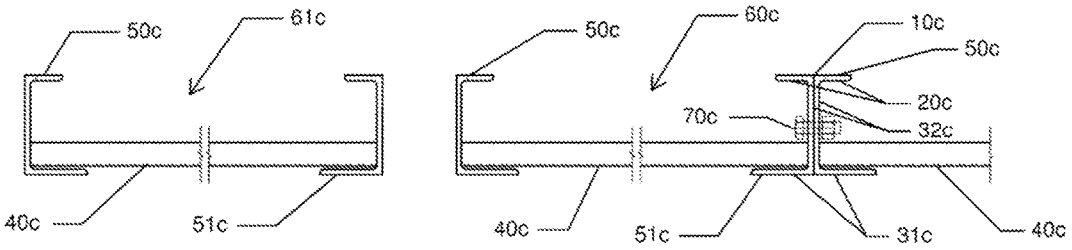
FIG. 3C is a section view of one embodiment of a load carrying structural beam and deck assembly in accordance with the teachings of the present disclosure.
Figure 3D:
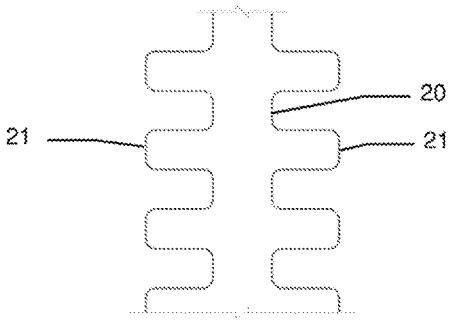
FIG. 3D is a top view of one embodiment of a serrated top flange in accordance with the teachings of the present disclosure and which is included in the beam members of FIG. 3A, FIG. 3B and FIG. 3C.
Figure 3E:
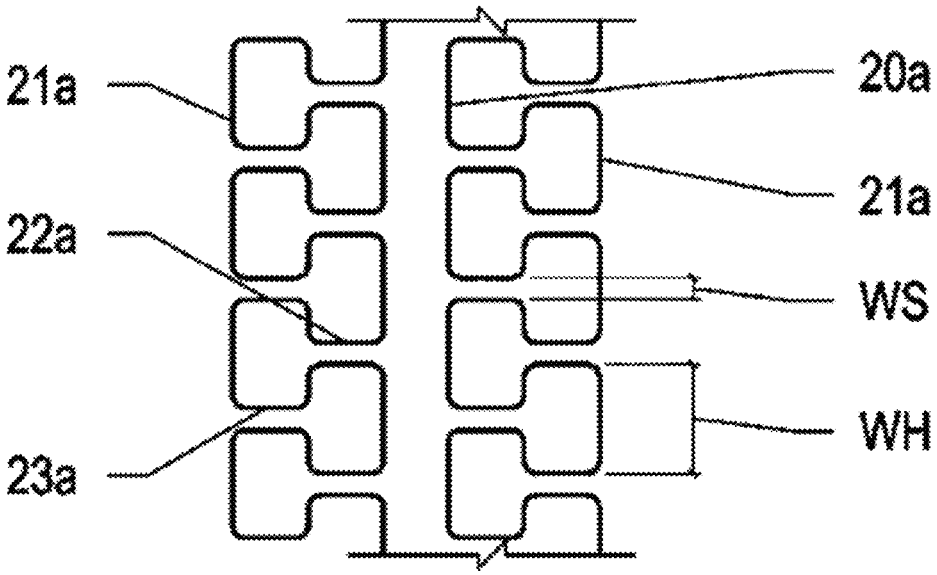
FIG. 3E is a top view of an alternative embodiment of a serrated top flange in accordance with the teachings of the present disclosure and which is included in the beam members of FIG. 3A, FIG. 3B and FIG. 3C.

FIGS. 3A, 3B and 3C show cross section views of adjacent beam and deck assemblies. Adjacent beam and deck assemblies 60 and 61 are comprised of a portion 50 of the overall cross section of a beam member 10, a portion 51 of an adjacent beam member 10, portions 50 and 51 interconnected by a deck assembly 40 prior to installation of beam and deck assemblies 60 and 61. Upon installation beam and deck assembly 61 is attached to adjacent beam and deck assembly 60 by fastening portion 51 to portion 50 using fasteners 70. The connection of portion 51 to portion 50 results in the completion of the full cross section of a beam member 10. The right end of beam and deck assembly 60 is shown having portion 51 installed and fastened to an adjacent beam and deck section resulting in the completion of beam member 10, which is comprised of serrated top flange 20. Aligned serrations 21 protrude horizontally from each side of serrated top flange 20. Serrations 21 may be of the type described more fully in U.S. application Ser. No. 15/929,292. In particular, as best seen in FIG. 3E, the headed serrations 21*a* on one side of serrated top flange 20*a* are staggered along the length of serrated top flange 20*a* in relation to the serrations 21*a* on the opposite side of serrated top flange 20*a*. Each serration 21*a* is comprised of a head 23*a* and a shaft 22*a* whereby the width "WH" of the head 23*a* measured parallel to the long axis of the top flange 20*a* is greater than the width "WS" of the shaft 22*a* measured parallel to the long axis of the top flange 20*a*. A concrete slab (not shown) is to be placed over deck assemblies 40 to a depth fully encasing serrated top flange 20. Serrated top flange 20 is interconnected to vertical web members 32. vertical web members 32. Vertical web members 32 are interconnected with bottom flange members 31. Decking 40 spans between the bottom flange of the beam members to support the concrete slab during placement and participates in transferring superimposed loads imparted to the concrete slab to beam member 10. The connection of deck assembly to beam member 10 restrains beam member 10 from torsional movement thereby mitigating lateral torsional buckling of beam member 10 during placement of the concrete slab. FIG. 3D shows a top view of serrated top flange 20, which includes aligned serrations 21 each side. Serrations 21 engage the concrete slab such that the serrated top flange 20 and the concrete slab undergo strains of similar magnitude and direction under applied loading along the length of top flange 20 thereby creating composite action.

Figure 4A:
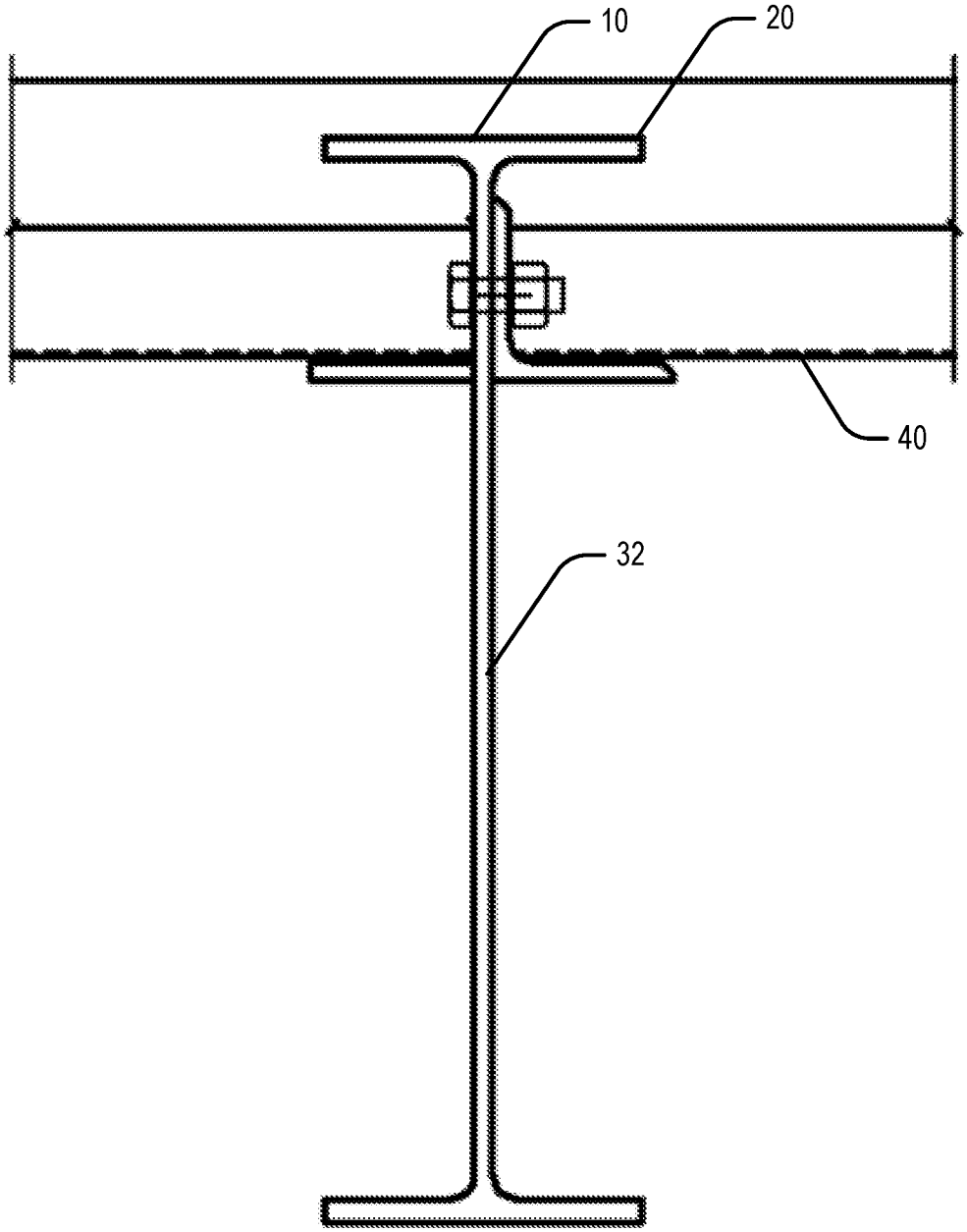
FIGS. 4A and 4B show a further embodiment of a beam with a serrated top flange and an elongated web portion.
Figure 4B:
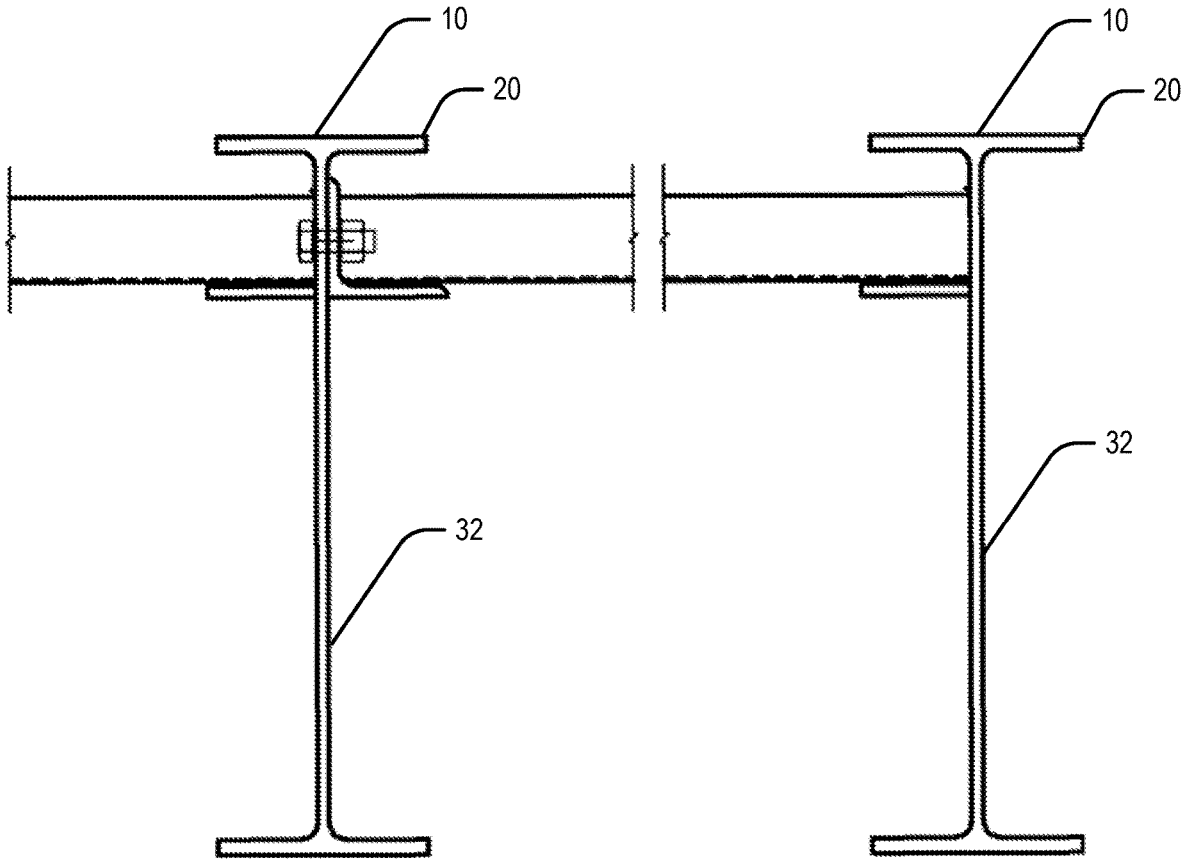

FIG. 4A is a further embodiment showing a deep girder embodiment. A beam member 10 may be comprised of a serrated top flange 20 as described above. This embodiment may include an elongated vertical web members 32 which extends down below the deck assembly 40. The beam member 10 may extend through a center portion of the deck assembly 40 or an end portion of the deck assembly 40 as shown in FIG. 4B.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

I claim:

1. A structural flooring assembly spanning one or more structural supports, the structural flooring assembly comprising:

a first structural panel, comprising:

a first structural beam member comprising:

a first horizontal top flange member, a first vertical web member having a first end extending from a longitudinal center of the first top flange member, and a first bottom partial flange member extending at an angle from a second end of the first vertical web member;

a first length of decking defined by a first edge and a second edge, wherein the first structural beam member is fastened to the first edge of the first length of decking with the first bottom partial flange member extending in a first direction beneath the first length of decking; and a second structural beam member fastened to the second edge of the first length of decking, the second structural beam member comprising a second vertical web member and a second bottom partial flange member extending at an angle from the second vertical web member, the second bottom partial flange member extending in a second direction beneath the first length of decking toward the first bottom partial flange member; and a second structural panel, comprising:

a third structural beam member comprising:

a second horizontal top flange member, a third vertical web member having a first end extending from a longitudinal center of the second top flange member, and a third bottom partial flange member extending at an angle from a second end of the third vertical web member;

a second length of decking defined by a third edge and a fourth edge, wherein the third structural beam member is fastened to the third edge of the second length of decking with the third bottom partial flange member extending in the first direction beneath the second length of decking; and a fourth structural beam member fastened to the fourth edge of the second length of decking, the fourth structural beam member comprising a fourth vertical web member and a fourth bottom partial flange member extending at an angle from the fourth vertical web member, the fourth bottom partial flange member extending in the second direction beneath the second length of decking toward the third bottom partial flange member;

wherein the third structural beam member is directly affixed to the second structural beam member so that the second and third structural beam members together form a beam having an "I"-shaped cross-section with top and bottom full flanges and a central portion extending between the top and bottom portions.

2. The structural flooring assembly of claim 1, wherein the third structural beam member is affixed to the second structural beam member using a plurality of bolts.

3. The structural flooring assembly of claim 1, wherein the third structural beam member is affixed to the second structural beam member so that the second bottom partial flange member of the second structural beam member and the third bottom partial flange member of the third structural beam are coplanar and extend in opposite directions.

4. The structural flooring assembly of claim 3, wherein the third vertical web member of the third structural beam member is bolted to the second vertical web member of the second structural beam member.

5. The structural flooring assembly of claim 1, wherein the first vertical web member comprises first and second vertical plates bolted to each other, and the third vertical web member comprises third and fourth vertical plates bolted to each other.

6. The structural flooring assembly of claim 1, wherein:

the first bottom partial flange member extends at a right angle from the second end of the first vertical web member, the second bottom partial flange member extends at a right angle from the second vertical web member, the third bottom partial flange member extends at a right angle from the second end of the third vertical web member, and the fourth bottom partial flange member extends at a right angle from the fourth vertical web member.

7. The structural flooring assembly of claim 1, wherein the first and second horizontal top flange members are serrated.

* * * * *